United States Patent [19]

Sterzel

[11] Patent Number: 4,634,312

[45] Date of Patent: Jan. 6, 1987

[54] SELF CLEANING DRAIN GUTTER OR PIPE

[76] Inventor: Erich Sterzel, Brink 36, 4270 Dorsten 12, Fed. Rep. of Germany

[21] Appl. No.: 607,222

[22] Filed: May 4, 1984

[30] Foreign Application Priority Data

May 11, 1983 [DE] Fed. Rep. of Germany ..... 3317228
May 28, 1983 [DE] Fed. Rep. of Germany ..... 3319424

[51] Int. Cl.[4] ..... E02B 9/04; E04D 13/00; B08B 3/00

[52] U.S. Cl. ..... 405/119; 52/11; 134/166 C; 134/171

[58] Field of Search ..... 405/36, 43, 118, 119–123, 405/80; 52/11, 12, 16; 134/166 C, 171, 168 C, 169 C

[56] References Cited

U.S. PATENT DOCUMENTS

| | | | |
|---|---|---|---|
| 1,485,499 | 3/1924 | Fleharty | 405/119 X |
| 2,887,073 | 5/1959 | Thompson | 52/12 X |
| 3,507,396 | 4/1970 | Homa | 52/12 X |
| 3,802,449 | 4/1974 | Mulinex | 134/166 C |
| 4,028,895 | 6/1977 | Franzmeier | 405/120 |
| 4,142,370 | 3/1979 | Giordano | 52/11 X |
| 4,183,368 | 1/1980 | Husted | 52/16 X |
| 4,407,097 | 10/1983 | Allen | 52/11 |

*Primary Examiner*—Cornelius J. Husar
*Assistant Examiner*—Nancy J. Stodola
*Attorney, Agent, or Firm*—Collard, Roe & Galgano

[57] ABSTRACT

There is provided a self cleaning drainage channel, particularly a drain gutter or pipe, wherein any solid material particles deposited therein and clogging the same may be removed by a nozzle system distributed along the length of the drainage channel provided with injection nozzles oriented in the drainage direction to which a rinsing medium is supplied.

10 Claims, 6 Drawing Figures

SELF CLEANING DRAIN GUTTER OR PIPE

The present invention relates to drainage channels, particularly drain gutters or pipes used in buildings, such as roof gutters, in agricultural enterprises as in stables for farm animals, or in below ground structural work for drainage. More particularly, the present invention relates to such a drainage channel which is self cleaning.

It is known that such drainage channels clog easily if the drain water being discharged includes solid particles which are deposited in the channels, or where solid particles from other sources, for example, leaves, sand or the like, pass into the discharge channel. The cleaning of clogged drainage channels requires a considerable effort, particularly where such channels are not easily accessible or are enclosed or of a closed construction.

It is, therefore, an object of the present invention to provide a drainage channel which can be kept free of solid particle deposits by self cleaning means.

In order to accomplish this object, it is proposed by the present invention that the drainage channel be equipped with injection nozzles distributed along the length of the channel, which are oriented in the drainage direction and to which a rinsing medium can be supplied.

A drainage channel of this type can be kept clean in a simple manner and fashion by a rinsing medium being passed to the injection nozzles from time to time. The rinsing medium squirted into the channel under relatively high pressure picks up solid particles deposited therein and rinses them away. Since such a cleaning of the drainage channel requires almost no effort, the cleaning process can be repeated at relatively short time intervals, thereby eliminating the problem of the deposits solidifying. Such solidified deposits make cleaning of the drainage channel much more difficult.

In a preferred version of the self-cleaning drainage channel according to the present invention, the channel includes at least one conduit equipped with injection nozzles, through which the rinsing medium is supplied. This conduit provided with injection nozzles may be installed in the walls or floor of the drainage channel during manufacture. Alternatively, it is also possible, according to the present invention, to install such conduits into already manufactured drainage channels subsequently as a retrofit cleaning system.

This conduit may, for example, be disposed on the floor of the channel and, in that case, is advantageously matched to the cross section of the channel. Such conduit effectively covers the entire bottom or floor of the channel or forms a floor thereof, and is provided at regular intervals with injection nozzles.

Alternately, tubular-shaped conduits can be disposed on the lateral walls of the drainage channel. The injection nozzles disposed along the tubular-shaped conduits squirt the rinsing medium along the drainage direction towards the walls of the channel, so that a cushion of liquid is provided on the walls of the channel along which the solid particles float away. In the event the drainage channel is a roof gutter, both tubular-shaped conduits can advantageously be disposed in the respective lateral bulges of the roof gutter. In this manner, the roof gutter has an appearance which does not differ from conventional roof gutters.

In order to accelerate the transportation of the solid particles along the channel being cleaned and to facilitate the cleaning thereof, there can also be provided above the floor of the channel a tube or pipe equipped with injection nozzles. These injection nozzles impart to the solid particles floating on the above-mentioned liquid cushion an additional impulse in the discharge or drainage direction, so that relatively thick deposits of solid particles can be transported away in a satisfactory manner.

The conduits and tubes are preferably formed together with the nozzles by the injection molding of synthetic materials. Manufacture of the conduits and nozzles by injection molding synthetic material is, on one hand, very cost effective, and furthermore has the advantage that damage due to corrosion cannot take place, particularly in the area of the nozzles. As the nozzles are impacted on only from time to time, and then only for a short time, the injection molded nozzles have an adequate rigidity for this purpose. So as to loosen any particularly tenacious deposits of solid particles, the injection nozzles may additionally be impacted on with a rinsing medium which is gaseous or in vapor form.

According to another embodiment, the drainage channel consists of an inner tube having injection nozzles in the wall thereof, the inner tube being surrounded by an outer tube, and the rinsing medium passing into the annular channel formed between the inner tube and the outer tube. In this manner a drainage channel is formed which, as viewed from the exterior thereof, has the form of a normal tubular drainage conduit, but which nevertheless can be kept free of deposits in a simple manner.

In order to maintain the inner tube approximately in the center of the outer tube, distance spacers are disposed between the inner tube and the outer tube. If both the outer and inner tubes are formed by extrusion of synthetic materials which are subsequently assembled with the aid of the distance spacers, a particularly simple manufacturing process results. In this case, the injection nozzles of the inner tube are advantageously bores formed in the wall of the inner tube.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views.

Figure 1:
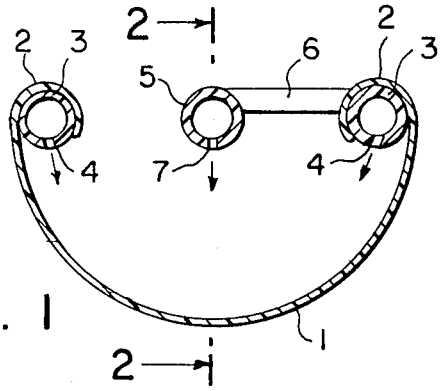
FIG. 1 is a cross-sectional view of a drainage channel formed as a roof gutter according to the present invention.
Figure 2:
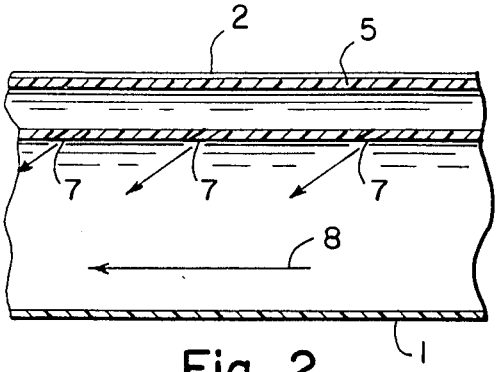
FIG. 2 is a longitudinal cross-sectional view of the roof gutter of FIG. 1 taken along the line 2—2 of FIG. 1.

Now turning to the drawings, there is shown in FIGS. 1 and 2 a drainage channel, designated 1, formed as a roof gutter with a substantially semi-circular cross section and having on both sides lateral bulges 2 which are typical for roof gutters. Into each of these rims or lateral-bulges 2, there is inserted a tube 3, which, as seen in the longitudinal direction of channel 1, are provided at regular intervals with injection nozzles 4. In the center and above the bottom of the drainage channel 1, there is disposed a further tube 5, which is connected by means of a plurality of lateral supports or carriers 6 to the rim or lateral bulges 2 of channel 1, and which is also equipped with injection nozzles 7. Injection nozzles 4 and 7 in tubes 3 and 5, respectively, are inclined or directed along the drainage direction, the drainage direction being designated by arrow 8 in FIG. 2. In this way, any solid particles deposited in drainage channel 1 receive an impulse along the drainage direction by the rinsing medium being discharged through the injection nozzles. Injection nozzles 4, which are associated with the walls of channel 1, are further disposed so as to direct the rinsing medium in a substantially tangential direction with respect to the arcuate walls of channel 1, so that a liquid cushion is formed therealong on which the solid particles float.

Figure 3:
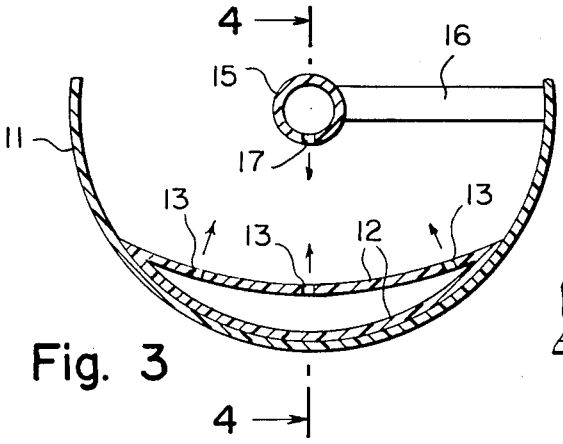
FIG. 3 is a cross-sectional view of a second embodiment of a drainage channel according to the present invention.
Figure 4:
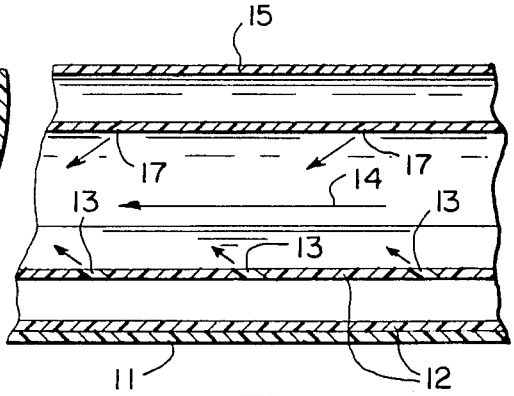
FIG. 4 is a longitudinal cross-sectional view of the embodiment of FIG. 3 taken along the line 4—4 of FIG. 3.

In the embodiment according to FIGS. 3 and 4, there is disposed a conduit 12 at the bottom of the drainage channel 11. Conduit 12 may be adapted to match the cross section of channel 11 and is provided with injection nozzles 13 at regular spacings in the longitudinal direction thereof. Injection nozzles 13 also extend, as can be seen in FIG. 4, so as to be inclined or oriented with respect to the drainage direction, designated by the arrow 14, so that they impart an impulse to the solid particles deposited in drainage channel 11 along the drainage direction. Also, in this embodiment, there is disposed above the center of the bottom of channel 11 a tube 15 provided with injection nozzles 17 and lateral supports 16. Tube 15 corresponds to tube 5 of FIGS. 1 and 2.

Tubes 3, 5 and 15, as well as conduit 12, are preferably manufactured by the injection molding of synthetic material. Injection nozzles 4, 7, 13 and 17 are preferably molded together with tubes 3, 5, 15 and conduit 12. Tubes 3, 5, 15 and conduit 12 can be manufactured separately and later installed into available drainage channels. Alternatively, they can be integrated into the walls of the drainage channels during manufacture.

Tubes 3, 5, 15 and conduit 12, are connected to a pump (not shown) which supplies the rinsing medium under pressure to injection nozzles 4, 7, 13 and 17. Optionally, injection nozzles 4, 7, 13 and 17 can be supplied with a rinsing medium in the form of compressed gas or vapor. In the latter case, the compressed gas or vapor is also supplied to the injection nozzles via the tubes or conduit.

Figure 5:
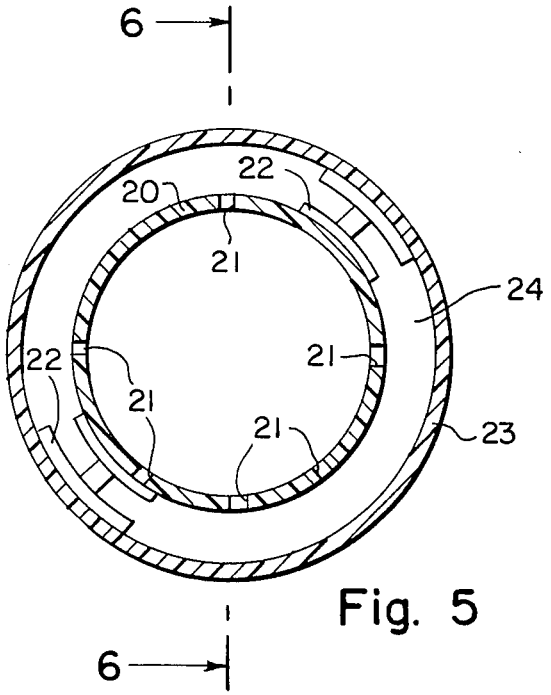
FIG. 5 is a cross-sectional view of a tubular-shaped drainage channel according to the present invention.
Figure 6:
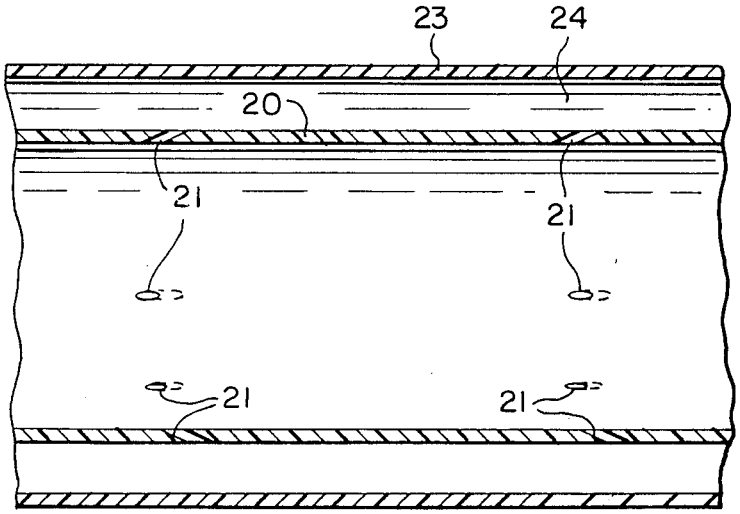
FIG. 6 is a longitudinal cross-sectional view of the embodiment of FIG. 5 taken along the line 6—6 of FIG. 5.

In the embodiment shown in FIGS. 5 and 6, the drainage channel consists of an inner tube 20 which preferably is formed of an extruded tube of synthetic material. In the walls of inner tube 20 there are disposed injection nozzles 21 which are formed as bores in the walls of inner tube 20 and which are inclined in the drainage direction. Distance spacers 22 are disposed on the outer periphery of inner tube 20 and serve to support an outer tube 23 surrounding and spaced from inner tube 20. Outer tube 23 is also preferably formed as an extruded tube of synthetic material.

Annular space 24, defined between inner tube 20 and outer tube 23, may be supplied with a rinsing medium in such a manner that the rinsing medium, when the inner space of the inner tube 20 is to be cleaned, is discharged through injection nozzles 21 and rinses off any deposits from the inner space of inner tube 20.

While only a few embodiments of the present invention have been shown and described, it will be obvious that many changes and modifications may be made thereto without departing from the spirit and scope of the present invention.

What is claimed is:

1. A self cleaning drainage channel, comprising a drainage channel, at least one conduit disposed at the bottom of said drainage channel and matched to the cross-sectional shape thereof, and a nozzle system integrated into the drainage channel which includes injection nozzles provided in said at least one conduit approximately at regular intervals along the length of said drainage channel oriented in the drainage direction, a rinsing medium being supplied under relatively high pressure through said at least one conduit to said injection nozzles, which direct the rinsing medium directly at the bottom of said channel exclusively towards said drainage direction so that it imparts an impulse to solid particles at the bottom of the channel.

2. The self cleaning drainage channel according to claim 1, which further includes two additional conduits provided with injection nozzles disposed on the lateral walls of said drainage channel.

3. The self cleaning drainage channel according to claim 2, wherein the drainage channel is a roof gutter including lateral bulges at the rims thereof and said two additional conduits are disposed in said lateral bulges.

4. The self cleaning drainage channel according to claim 1, which further includes an additional conduit disposed above and in the center of said channel, said additional conduit being provided with injection nozzles.

5. The self cleaning drainage channel according to claim 4, wherein said conduits and nozzles are formed by the injection molding of synthetic material.

6. The self cleaning drainage channel according to claim 3, wherein said conduits and nozzles are formed by the injection molding of synthetic material.

7. A self cleaning drainage channel comprising a drainage channel in the form of an inner pipe, an outer pipe surrounding said inner pipe and defining an annular space therebetween, said annular space being supplied with a rinsing medium, and a nozzle system integrated into the drainage channel which includes a plurality of injection nozzles distributed approximately at regular intervals along the length of said inner pipe oriented in the drainage direction, the rinsing medium forcefully squirting out of said nozzles and into said inner pipe under relatively high pressure which, upon discharge from said injection nozzles, is directed exclusively towards said drainage direction for cleaning the drainage channel of debris.

8. The self cleaning drainage channel according to claim 7, which further includes distance spacers disposed between the inner and outer pipes.

9. The self cleaning drainage channel according to claim 7, wherein said outer and inner pipes are formed by the extrusion of synthetic material.

10. The self cleaning drainage channel according to claim 7, wherein the injection nozzles of the inner pipe are bores formed in said inner pipe.

* * * * *